United States Patent [19]

Kosmol et al.

[11] Patent Number: 4,795,357

[45] Date of Patent: Jan. 3, 1989

[54] LAMP HOLDER FOR FLUORESCENT LAMPS

[75] Inventors: Joachim Kosmol, Wendelstein; Thomas Krummer, Weissenburg, both of Fed. Rep. of Germany

[73] Assignee: Diehl GmbH & Co., Nuremberg, Fed. Rep. of Germany

[21] Appl. No.: 139,182

[22] Filed: Dec. 29, 1987

Related U.S. Application Data

[63] Continuation-in-part of Ser. No. 917,166, Oct. 9, 1986.

[30] Foreign Application Priority Data

Oct. 23, 1985 [DE] Fed. Rep. of Germany ..... 3537601

[51] Int. Cl.[4] ..... H01R 39/00

[52] U.S. Cl. ..... 439/232

[58] Field of Search ..... 439/226, 230, 231, 232, 439/233, 234, 235, 239, 240, 241

[56] References Cited

U.S. PATENT DOCUMENTS 2,702,377 2/1955 Dahlhaus et al. ..... 339/54

3,851,295 11/1974 Geier ..... 339/54

FOREIGN PATENT DOCUMENTS 1028686 4/1958 Fed. Rep. of Germany ..... 339/54

*Primary Examiner*—Joseph H. McGlynn

*Attorney, Agent, or Firm*—Scully, Scott, Murphy & Presser

[57] ABSTRACT

A lamp holder for fluorescent lamps, which incorporates a latching arrangement, especially for utilization in the passenger cabin of airplanes. The lamp holder includes two adjacently located inserting slots for the lateral or end-projecting contact pins of the fluorescent lamp, into which inserting slots there project retaining pins, which are displaceable opposite a spring force, for effecting the latching of the contact pins; wherein an unlatching knob or pushbutton is adapted to act on the retaining pins, and wherein there is present a guiding channel extending in parallel with the inserting slots for the guidance of the fluoescent lamp. In the area of the guiding channel, there may also be arranged resilient elements extending in parallel with the inserting slots for the retention of the fluorescent lamp in its ejected position.

5 Claims, 2 Drawing Sheets

LAMP HOLDER FOR FLUORESCENT LAMPS

CROSS-REFERENCE TO RELATED APPLICATIONS

This application is a continuation-in-part of patent application No. 917,166; filed Oct. 9, 1986.

BACKGROUND OF THE INVENTION

1. Field of the Invention

The present invention relates to a lamp holder for fluorescent amps, which incorporates a latching arrangement, especially for utilization in the passenger cabin of airplanes.

2. Discussion of the Prior Art

The usual fluorescent lamps are introduced into their holders through the insertion of their lateral or end contact pins into a guiding slot, and are then placed into their operative position through the application of pressure with a concurrent rotation of the lamp. This "turning-in" sequence cannot be implemented in a particularly comfortable manner, and especially in the utilization of such fluorescent lamps in the passenger cabins of airplanes subject to extremely narrow or restrictive space conditions, the insertion of such fluorescent lamps necessitates the expenditure of considerable amounts of effort.

Furthermore, it is also known to secure the fluorescent lamps in their holders against their dropping out through the employment of latching lever, particularly during their use in airplanes.

SUMMARY OF THE INVENTION

Accordingly, commencing from foregoing conditions, it is an object of present invention to provide a lamp holder for fluorescent lamps, in which the introduction of the fluorescent lamps into the holder is extremely simple in nature, and is possible to carry out in the absence of any rotation, and which results in an automatic or self-acting latching engagement. Moreover, as a further constructional capability there can be contemplated the provision of a simple safety mechanism as a protection against the ejection of the fluorescent lamp upon its unlatching within the holder.

In order to achieve the foregoing object, the present invention provides a construction for the lamp holder in which there are provided two side-by-side adjacently located inserting slots for the laterally or end projecting contact pins of the fluorescent lamp, into which inserting slots there project retaining pins which are displaceable in opposition to a spring force, for effecting the latching of the contact pins; wherein an unlatching knob or pushbutton is adapted to act on the retaining pins, and wherein there is present a guiding channel extending in parallel with the inserting slots for the guidance of the fluorescent lamp.

Due to the inventive construction and design of the lamp holder it is possible to position the fluorescent lamp with its laterally extending or end contact pins in the inserting slots of the holder, and to then merely press the fluorescent lamp into the holder. Consequently, there is hereby automatically effected an adjustment of the contact pins into the applicable inserted position, as well as subsequent to the completed pressing into the holder, an automatic latching of the lamp.

Should it be desired to incorporate a safety against ejection or falling out of the fluorescent lamp upon its unlatching, such a capability being especially desirable in airplanes, then a modified embodiment of the invention contemplates that in the region of the guiding channel, there be arranged resilient elements extending in parallel with the inserting slots for effecting the retention of the fluorescent lamp in its ejected position.

BRIEF DESCRIPTION OF THE DRAWINGS

Further advantages of the invention can now be readily ascertained from the following detailed description of a preferred embodiment of a lamp holder for fluorescent lamps, taken in conjunction with the accompanying drawings; in which.

DETAILED DESCRIPTION

Figure 1:
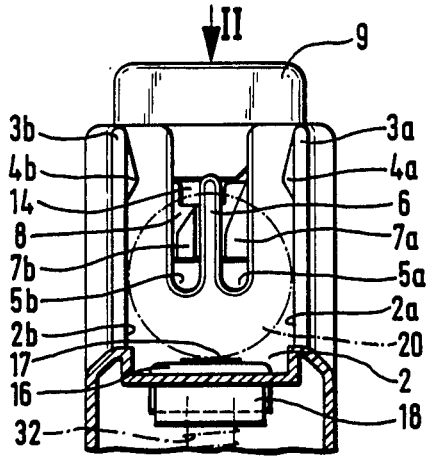
FIG. 1 illustrates a front end view of the lamp holder showing the inserting slots.
Figure 2:
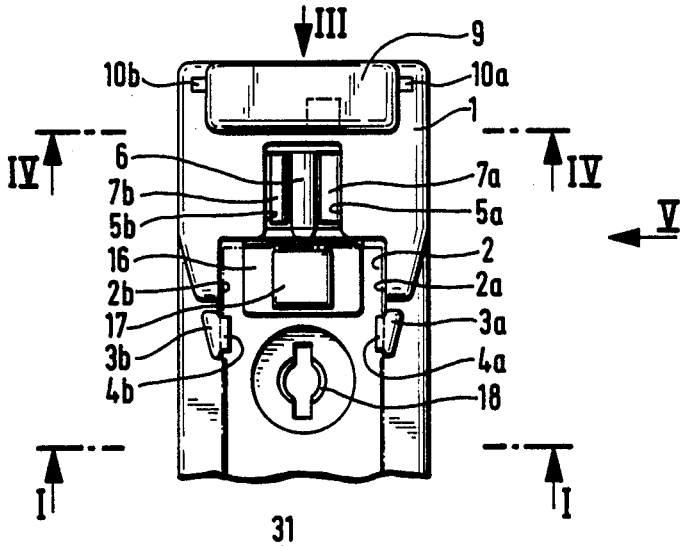
FIG. 2 illustrates a top plan view of the lamp holder.

As illustrated in the drawings, a molded plastic material element is constructed to provide a holder 1 for the one end of a fluorescent lamp. This holder 1 includes an upwardly opening guiding channel or passageway 2 having walls **2*a* and 2*b*** at a spacing from each other which is only slightly wider than the diameter of the fluorescent lamp, so that the latter can be readily inserted from above into the guiding channel or passageway of the holder.

In the region of the guiding channel, and forming a portion thereof, there are provided two resilient flaps or tongues **3*a* and 3*b* integrally connected with the holder at their base portions, which include protuberances 4*a* and 4*b* at their upper ends, and which face each other, which engage behind the lamp in its inserted and also in its ejected position, and prevent the lamp from falling out. A fluorescent lamp which is inserted into the lamp holder is illustrated by phantom-lines in FIG. 1** in its normal operating position.

In contrast with the usual lamp holders, the inserting slots **5*a* and 5*b* for the contact pins of the fluorescent lamp are located in parallel adjacent each other, and are separated from each other by a spacer web 6. The metallic electrical contact pieces in the holder, for purposes of clarity, and not being necessary for an understanding of the invention, are not illustrated in the drawing. Protruding into the guide slots are retaining pins 7*a* and 7*b*, the latter of which are mounted on a latching plate 8, and are laterally displaceable together with the plate 8 towards the right, as shown in the drawing, in opposition to a spring force normally tending to bias the plate 8** towards the left.

Figure 3:
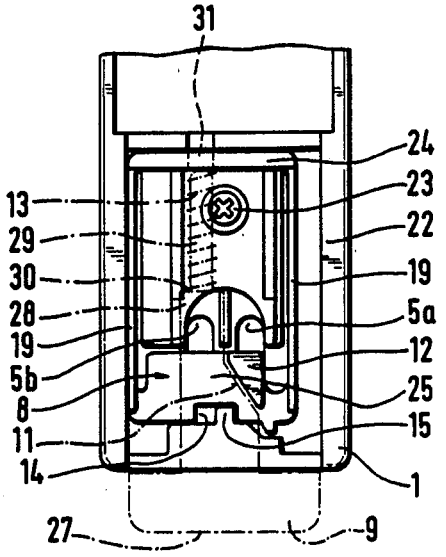
FIG. 3 illustrates a rear view of the lamp holder, wherein the unlatching knob or pushbutton is indicated by phantom-lines.

Provided in the holder 1 is an unlatching or release knob 9 or pushbutton which can be depressed into the holder in opposition to a spring force. This unlatching knob is supported in guide rails **10*a* and 10*b*. Illustrated in FIG. 3 is the rear side of this unlatching knob or pushbutton 9, which has the end thereof facing towards the guiding slots 5*a*, 5*b* provided with its operating structure, as shown in phantom-lines in the drawing. It is ascertainable that the unlatching knob or pushbutton possesses an inclined plane 11, which cooperates with a protrusion 12 on a corresponding shaped inclined plane on the latching plate 8**.

Figure 4:
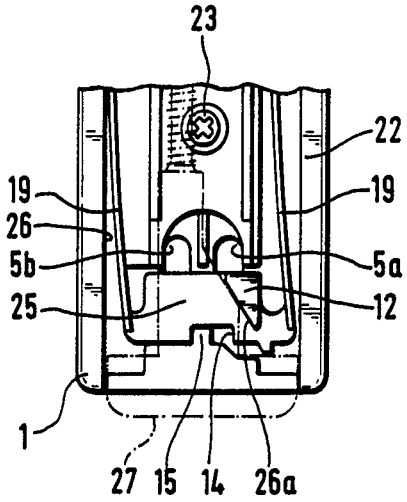
FIG. 4 illustrates a view similar to FIG. 3 showing the unlatching pushbutton in a depressed position.
Figure 5:
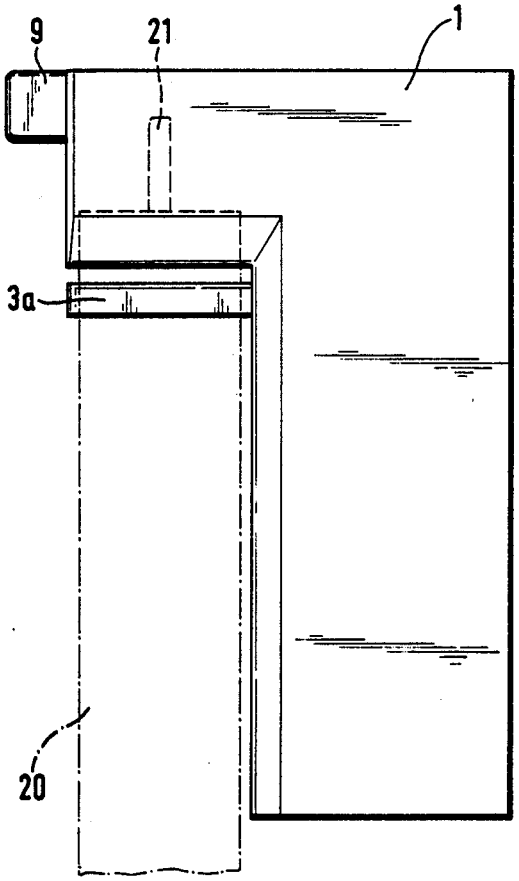
FIG. 5 illustrates a side view of the lamp holder viewed in the direction of arrow V in FIG. 2.
Figure 6:
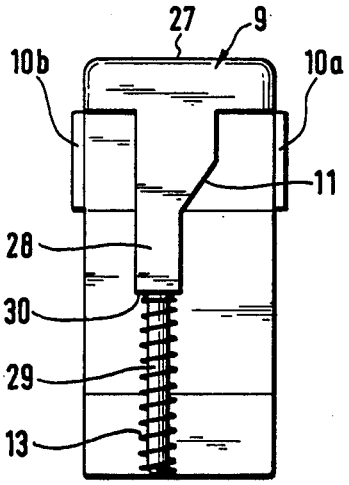
FIG. 6 illustrates, in a side view, a detail of the pushbutton for the lamp holder.

The latching element or plate 8 is provided on the rear side 22 of the holder 1, as shown in FIGS. 3 to 5, and is fastened thereto by means of a screw 23. This latching element 2 includes resilient webs or connectors 19 which are parallel to each other and which extend from a base plate 24, with the connectors 19 being interconnected with each other in the head region through a bridge 25. The arrangement of the latching element 8 within the housing 1 is so undertaken, that in the position which corresponds to the latching of the lamp, one of the two resilient connectors 19 contacts interiorly against the housing or holder wall 26.

The bridge 25 is integrally provided, on the surface which faces towards the inserting slots 5*a*, 5*b*, with retaining projections 7*a* and 7*b*, which extend into the inserting slots 5*a* and 5*b*. On the rearward surface relative to the retaining projection 7*a* and 7*b*, the bridge 25 possesses an integrally attached cam 12 with an inclined or angled sliding surface 26*a*. The upper end surface of the bridge 25 includes the recess 14 of predetermined width, into which there engages a stationary protuberance 15 on the holder 1.

The latching element or plate 8 is closed off at its rear side by the unlatching pushbutton or slider 9 which is movable in guide grooves 10*a* and 10*b*, and wherein the slider concurrently serves as the base of the holder 1. The unlatching slider 9 is provided at its outer end surface 27 with a pushbutton surface, from which there integrally extends a web 28 on the inside thereof, which includes, in its central region, the inclined plane or surface 11, and in its end region is formed as a cylindrical pin 29. On the cylindrical pin 29 there is arranged the coil spring 13, which supports itself against a shoulder 30 on the web 28, and which contacts with its opposite end against an inner wall of the holder 1, whereas this inner wall concurrently includes a bore 31 for the through-passage of the cylindrical pin 29.

In the bottom surface of the guide passageway 2, near the rear wall of the holder 1, there is inserted the ejector button 16 which, under the action of a spring 32, constantly projects into the guide passageway 2. The end surface of the ejector button 16 is equipped with a soft plastic material insert 17, against which there contacts an inserted fluorescent lamp 20

Furthermore, a screw holder 18 is provided in the bottom surface of the guide passageway 2, which serves for the receipt of a screw for fastening the lamp holder to a ceiling or wall.

Thus, for the insertion of a fluorescent lamp 20 it is initially required that two lamp holders be located at a certain spacing relative to each other with the inserting slots 5*a*, 5*b* being oppositely located; mounted, for example, on the ceiling of a chamber or a cabin, and fastened by means of screws. The insertion and retaining of the fluorescent lamp 20 in the lamp holder is quite simple. The contact pins 21 of the fluorescent lamp 20 are introduced into the inserting slots 5*a*, 5*b*. Hereby, the contact pins 21 displace the retaining projections 7*a*, 7*b* together with the bridge 25 from the position shown in FIG. 3 into the position shown in the sketch of FIG. 4 This displacement is effected opposite to the action of the resilient web 19 up to the contact of the projection 19 against the side wall of the recess 14. As soon as the contact pins 21 of the fluorescent lamp 20 have been pressed downwardly past the retaining projection 7*a*, 7*b*, the webs 19 spring back into the original position pursuant to FIG. 3, whereby a falling out of the fluorescent lamp 20 is no longer possible. During the insertion of the fluorescent lamp 20 into the lamp holder, the ejector knob 16 is concurrently pressed into the guide passageway 2 against the action of the spring 32. Furthermore, the tongues 3*a*, 3*b* lie resiliently against the casing surface or the fluorescent lamp 20.

When it is intended to remove the fluorescent lamp from the holder 1, the unlatching slider 19 is merely pressed in against the force of the coil spring 13. Thereafter, the inclined surface 11 of the connector 28 slides at an increasing extent along the facing inclined surface of the cam 12, whereby the cam 12, together with the bridge 25 and the retaining projections 7*a*, 7*b*, are displaced sideways. The inserting slots 5*a*, 5*b* are thereby unblocked such that the fluorescent lamp 20 together with the contact pins 21 can be pressed out of the lamp holder through the spring-supported ejector knob 16.

Any falling out of the fluorescent lamp 20 is prevented, inasmuch as the tongues 3*a*, 3*b*, together with their protuberances 4*a*, 4*b*, are contacted under a light spring pressure against the casing surface of the fluorescent lamp 20, and engage therebehind. From this position, the fluorescent lamp can be easily removed by hand.

Thus, by means of the above-described construction of the lamp holder, during the insertion of a fluorescent lamp 20 there is no longer required any turning-in thereof into the operative position, which is of important advantage in the extremely limited installation space available in aircraft cabins. The inserted lamp is secured against falling out, and also after unlatching is retained in the ejected position against falling out, however, can be easily removed by hand.

Through the presence of a guide passageway there are avoided any possible erroneous insertions of the fluorescent 1a 20, namely that both contact pins 21 can be inadvertently place together into one of the inserting slots 5*a* or 5*b*.

The above-described lamp holder has a number of advantages over the commonly heretofore employed lamp holders. For the introduction of a fluorescent lamp, the contact pins need not be inserted in a precise manner into the guiding slots, but will center themselves during the proper insertion of the lamp. Hereby, the contact pins of the fluorescent lamp displace the retaining pins 7*a* and 7*b* outwardly, and come into contact with the bottom of the inserting slots 5*a* and 5*b*. After the contact pins have passed the retaining pins 7*a* and 7*b*, due to the spring force of the resilient tongue 19, the latter are moved back into their original position as illustrated in the drawing, and thereby latching the contact pins into position. Concurrently, with the introduction of the fluorescent lamp, the ejector plate 16 is pressed downwardly against a spring force. When the fluorescent lamp is to be removed, a pressure exerted against the end of the unlatching knob or pushbutton 9 is adequate, which by means of the inclined plane 11 and the protrusion 12 on the latching plate 8 will displace the retaining pins sideways. Through the action of the spring force of the ejector plate 16, the fluorescent lamp is then pressed upwardly in the now upwardly opening inserting slot, until it lies against the protuberances 4*a* and 4*b* of the resilient tongues and is secured against falling out. Hereby, the retaining pins 7*a* and 7*b* remain pressed towards the side due to the contact pins of the fluorescent lamp even after the release of the unlatching knob. Thereafter, the fluorescent lamp can be easily removed by hand from the holder.

Through the above-described construction of the holder, for the introduction of a fluorescent lamp there is no longer required any turning in thereof into the operative position, which represents an extremely important advantage, especially for the extremely limited space which available in airplane cabins. The inserted lamp is secured against any falling out, and even after unlatching into the ejecting position is also retained against falling out; however, it can be easily removed with the hand. Through the presence of a guiding channel there is avoided any kind of erroneous introductions of the fluorescent lamps; namely, in that both contact pins could be inadvertently introduced into a single inserting slot.

What is claimed is:

1. A lamp holder incorporating a latching device for retaining fluorescent lamps possessing a pair of projecting contact pins at the ends thereof in said holder, especially for utilization of said holder in the passenger cabin of airplanes, said lamp holder comprising two adjacently located inserting slots each for the receipt of respectively one of the contact pins of the fluorescent lamp; said latching device including a latching plate supporting retaining pins in said inserting slots for displacement opposite a spring force so as to retain the contact pins in said slots; an unlatching pushbutton movably mounted on said holder and including means for laterally displacing said retaining pins in said slots responsive to depression of said pushbutton for releasing said contact pins; a guiding channel in said holder extending in parallel with the inserting slots for the guidance of the fluorescent lamp; and resilient elements in said guiding channel engaging the fluorescent lamp in the released position thereof to inhibit said lamp from dropping out of said holder.

2. Lamp holder as claimed in claim 1, wherein said unlatching pushbutton is depressable into the holder in opposition to the force of a spring normally biasing said pushbutton outwardly of said holder; said pushbutton having a base portion displaceable in a direction in parallel with said inserting slots and having an inclined plane cooperable with a correspondingly-shaped inclined plane on the latching plate for laterally displacing said plate and said retaining pins responsive to depression of said pushbutton.

3. Lamp holder as claimed in claim 1, wherein said biasing spring acts on said base portion for displacing the pushbutton normally outwardly of said holder.

4. Lamp holder as claimed in claim 1, wherein a resiliently supported ejector plate of the fluorescent lamp is located at the end of said guiding channel.

5. Lamp holder as claimed in claim 1, wherein the guiding channel includes side walls spaced in conformance with the diameter of the fluorescent lamp, and said resilient elements comprise tongues arranged within said guiding channel, said tongues having end portions adapted to contact said fluorescent lamp so as to prevent the fluorescent lamp against falling out of said holder upon the release of said contact pins from said retaining pins in response to the depression of said pushbutton.

* * * * *